US006669788B1

(12) United States Patent
Xin et al.

(10) Patent No.: US 6,669,788 B1
(45) Date of Patent: Dec. 30, 2003

(54) PERMANENT MAGNETIC MATERIALS OF THE FE-B-R TPE, CONTAINING CE AND ND AND/OR PR, AND PROCESS FOR MANUFACTURE

(75) Inventors: Chen Pei Xin, Baotou (CN); Wang Biao, Baotou (CN); Ni De Zhen, Baotou (CN); Mark Gilbert Benz, Burnt Hills, NY (US); Juliana C. Shei, Niskayuna, NY (US)

(73) Assignees: General Electric Company, Schenectady, NY (US); Batou Iron and Steel (Group) Co. LTD, Batou City (CN)

( * ) Notice: Subject to any disclaimer, the term of this patent is extended or adjusted under 35 U.S.C. 154(b) by 0 days.

(21) Appl. No.: 09/673,045

(22) PCT Filed: Feb. 2, 2000

(86) PCT No.: PCT/US00/02649

§ 371 (c)(1),
(2), (4) Date: May 21, 2001

(87) PCT Pub. No.: WO00/48208

PCT Pub. Date: Aug. 17, 2000

(30) Foreign Application Priority Data

Feb. 12, 1999 (CN) ..... 99 1 02207 A

(51) Int. Cl.[7] ..... H01F 1/057

(52) U.S. Cl. ..... 148/302; 75/244; 419/12; 148/101; 148/103

(58) Field of Search ..... 148/101, 102, 148/103, 104, 302; 419/12; 75/244

(56) References Cited

U.S. PATENT DOCUMENTS 4,597,938 A 7/1986 Matsuura et al. ..... 419/23
4,684,406 A 8/1987 Matsuura et al. ..... 75/244
4,765,848 A * 8/1988 Mohri et al. ..... 148/302
4,793,874 A * 12/1988 Mizoguchi et al. ..... 148/103
4,908,076 A 3/1990 Iijima et al. ..... 148/302
4,975,130 A 12/1990 Matsuura et al. ..... 148/302
5,230,751 A * 7/1993 Endoh et al. ..... 148/302
RE34,838 E * 1/1995 Mohri et al. ..... 148/302
6,120,620 A * 9/2000 Benz et al. ..... 148/302
6,261,387 B1 * 7/2001 Panchanathan ..... 148/302

FOREIGN PATENT DOCUMENTS

EP 0286357 10/1988

OTHER PUBLICATIONS

Sequeira, W.P. et al, "The Magnetic Properties of Nanocrystalline Melt Spun Iron–Didymium–Boron Alloys", Material Letters, NL, Amsterdam vol. 15, No. 5 Jan. 1, 1993, pp. 376–378.

Pat. Abstracts of Japan, V. 1995, No. 3, Apr. 28, 1995 & JP 06 346200.

* cited by examiner

*Primary Examiner*—John Sheehan
(74) *Attorney, Agent, or Firm*—Jay L. Chaskin; Cantor Colburn LLP

(57) ABSTRACT

A Fe—B—R type permanent magnetic, consisting of: 13–19 atomic % R, where R consists essentially of a mixture of rare earth elements Nd and/or Pr, and Ce, where Ce is between 0.2 and 5.0 wt. % of R; 4–20 atomic % B, and the balance comprising Fe. In a preferred aspect, R comprises 15–16 atomic % B; of which Ce is approximately 0.5% and the remaining rare earths Pr and Nd are in a ratio of 3:1. A process of producing a Fe—B—R permanent magnet as described above, and a Fe—B—R magnetic material made by such process.

20 Claims, 5 Drawing Sheets

PERMANENT MAGNETIC MATERIALS OF THE FE-B-R TPE, CONTAINING CE AND ND AND/OR PR, AND PROCESS FOR MANUFACTURE

CROSS-REFERENCE TO RELATED APPLICATONS

This application is a continuation of the National Stage of International Application No. PCT/US00/02649 filed Feb. 2, 2000, which claims the benefit under 35 USC 119(a)–(d) of Chinese Patent Application No. 99102207.6 filed Feb. 12, 1999.

BACKGROUND OF THE INVENTION

The present invention relates to magnetic material compositions and a process for their manufacture, and more particularly performance magnetic material of the iron-boron-rare earth type (Fe—B—R).

Use of high performance permanent magnets of Fe—B—R type, where R is a rare earth element containing high concentrations of the element Neodymium (Nd) has become common in industry since the early 1980's. For example, computer hardware manufacturers who manufacture small footprint, large capacity computer data storage and retrieval hardware need permanent magnets in such devices. Due to severe size and weight restrictions inherent in such data storage devices, the permanent magnets contained therein must be relatively small yet have very strong magnetic properties to generate the required magnetic field. This has necessitated the use of very high performance Fe—B—R rare-earth permanent magnets within such devices.

In addition, medical diagnostic devices in the medical field, namely, magnetic resonance imaging (MRI) devices employ vast quantities (up to 1.5 tons) of permanent magnetic material, typically Fe—B—R magnets that contain high percentages of the rare earth Nd as the rare earth component.

Accordingly, due to the sale of these devices since the early 1980's employing Fe—B—R permanent magnets wherein the rare earth component is principally comprised of Nd, the worldwide demand for Nd has increased. As a result, the cost of the raw material Nd used in manufacture of such permanent magnets has greatly increased.

A real need has arisen to develop Fe—B—R magnets of substantially equal performance, which utilize less Nd to thereby reduce the cost of the manufacture of such magnets and the devices that contain such magnets.

Permanent magnets of the Fe—B—R type, where R is one or more rare earth elements of which at least 50% of R is Nd and/or Praseodymium (Pr), are known. For example, U.S. Pat. Nos. 4,684,406 and 4,597,938 both teach a high performance sintered permanent magnetic material of the Fe—B—R type. Such patents teach a high performance magnet consisting of, by atomic percent, (i) 12.5%–20% R wherein R is at least one rare earth element (selected from the group consisting of Nd, Pr, La, Ce, Tb, Dy, Ho, Er, Eu, Sm, Gd, Pm, Tm, Yb, Lu and Y) and at least 50% of R consists of Nd and/or Pr; (ii) 4–20%B; and (iii) the balance Fe with impurities. Likewise, as may be seen from U.S. Pat. No. 4,597,938, U.S. Pat. No. 4,975,130 and U.S. Pat. No. 4,684,606, such patents teach a process of preparing such a permanent magnet comprising forming powders of alloys of the above composition; melting same to form an ingot; pulverizing the ingot to form an alloy powder having a mean particle size from 0.3 to 80 microns; compacting such powder at a pressure of 0.5 to 8 Ton/cm$^2$; subjecting the compacted body to a magnetic field of about 7 to 13 kOe; and lastly sintering at a temperature between 900 to 1,200° C. (preferably 1,000 to 1,180° C.). A permanent magnet prepared in the above fashion specifically comprised of 77 Fe-9 B-9 Nd-5 Pr (wherein Nd and Pr together comprise the rare earth component), sintered at 1,120° C. for four hours in an inert atmosphere can acquire a high maximum energy product (BH)max of approximately 31.0 MGOe. Likewise, a permanent magnet comprised of 79 Fe-7 B-14 Nd, sintered at 1,120° C. for one hour at (atmosphere), can acquire a maximum energy product $(BH)_{max}$ of approximately 33.8 MGOe (ref. Table 1, U.S. Pat. No. 4,975,130). A sintered permanent magnet comprising 77Fe-7B-16Pr, sintered at 1,040° C. in a vacuum at $1\times10^{-4}$ torr for two hours can be produced having a maximum energy product somewhat less, namely, 24.5 MGOe.

None of these prior art patents disclose or suggest what significance, if any, the amount of Ce present or the concentration of Ce as part of R may have on Fe—B—R magnet performance. Nor does the prior art teach or suggest ranges of concentrations of Ce which may form part of the rare earth component of an Fe—B—R magnet in substitution for Nd which will give equal or better magnetic performance of an Fe—B—(Nd and/or Pr) permanent magnet.

BRIEF DESCRIPTION OF THE INVENTION

Applicants have discovered that relatively small percentages of Cerium, which in any event usually naturally occur in rare earth deposits containing Nd, may be included in certain defined percentages as part of the rare earth component "R" of an Fe—B—R magnet. R additionally comprises 70–76% Pr, 29.8–23.8% Nd and up to and including 5% Ce with no significant or only slight decrease in the magnetic performance of the resultant permanent magnet.

The applicants have further discovered that when certain low percentages of Cerium (0.5% wt. of R) are used in manufacture of an Fe—B—R permanent magnet in substitution of Nd, further substitution of Nd may further be made with Pr up to 76% which further substitution, particularly at Pr=75%, will not reduce, and indeed appears to substantially equal or even enhance, the magnetic performance characteristics over a magnetic material made up of the same total percentage of rare earth elements but lacking Ce, or having Ce but having higher concentrations of Nd.

By substitution of portions of Nd with specific small percentages of Ce and greater amounts of Ce in accordance with the invention herein disclosed, significant cost savings can be achieved in the manufacture of high performance permanent magnets of the Fe—B—R type, while substantially maintaining the magnetic performance of the magnet. Even in respect of certain concentrations of added or entrained Ce that may cause a reduction in the magnetic performance of the Fe—B—R magnetic material as compared with Fe—B—R magnetic material that employs substantially pure Nd, additional magnetic material having Ce and Pr as described herein can be used so as to make up the deficit in strength of magnetic field required in an MRI device.

Accordingly, in one broad aspect the applicants invention comprises a high performance permanent magnetic material of the Fe—B—R type, said material essentially consisting of:

(i) 13–19 atomic % R, where R comprises a mixture of rare earth elements Nd, Pr, and Ce wherein Ce is between approximately 0.2% and no more than 50 wt % of R and Pr is between 70–76% and 29.8–23.8% Nd;

(ii) 4–20 atomic % B;

(iii) the balance comprising Fe with impurities.

In preferred embodiments, the Fe—B—R magnet of the present invention essentially consisted of, by atomic %, 15–16% R, with Ce comprising 0.5–3 wt. %, and preferably 0.5%, with the remainder of R essentially consisting of Pr and/or Nd, preferably in the order of about 71.6% Pr and 24.9% Nd, i.e. a 3:1 ratio.

The present invention further comprises a sintered permanent magnetic material of the Fe—B—R type when made in accordance with the following process, namely:

(a) preparing a metallic powder having a mean particle size of 0.3–80 microns, said metallic powder formed from a composition essentially consisting of 15–16 atomic % R, wherein R essentially consists of the light rare earths Nd, Pr, and Ce, wherein Ce is between 0.2–5.0 wt. % of said R, the balance of R essentially consisting of 29.8–23.8% Nd and 70–76% Pr; 4–8 atomic % B, and at least 52 atomic % Fe;

(b) compacting said powder at a pressure of at least 1.5 ton/cm$^2$;

(c) sintering the resulted body at a temperature of 900–1200 C in a non-oxidizing or reducing atmosphere.

In addition, the applicants have found that while adding Cerium generally tends to decrease magnetic performance of Fe—B—R magnets having only Nd, by substituting Pr for Nd where Ce concentration is low will cause substantial restoration of lost magnetic performance. Accordingly, the applicant has found that using low concentrations of Ce (0.5% wt.) of R with the balance of R essentially consisting of approximately 74.6 wt. % Pr and approximately 24.9 wt. % Nd, wherein the aforementioned process is carried out such will produce a permanent magnet having magnetic performance criteria, namely $H_{ci}$ and $(BH)_{max}$ values, substantially equal to or somewhat in excess of an Fe—B—R magnet wherein the R component is comprising of only Nd and/or Pr.

The invention further comprises a method for producing sintered permanent magnets. In particular, the invention also comprises a process for preparing a sintered permanent magnetic material of the Fe—B—R type, said process comprising:

(a) preparing a metallic powder having a mean particle size of 0.3–80 microns, preferably no more than 4.0 microns, wherein the metallic powder essentially consists of a composition consisting of 15–16 atomic % R, wherein R essentially consists of the light rare earths Nd, Pr, and Ce, wherein Ce is between 0.1–5.0 wt. % of said R and preferably 0.5% of R, and preferably approximately 74% Pr and 25% Nd; 4–24 atomic % B and preferably 6.5 atomic % B; and at least 52 atomic % Fe and preferably 78 atomic %;

(b) compacting said powder at a pressure of at least 1.5 ton/cm$^2$;

(c) sintering the resulted body at a temperature of 900–1200 C in a non-oxidizing or reducing atmosphere.

BRIEF DESCRIPTION OF THE DRAWINGS

The following drawings show particular embodiments of the present invention in which.

DETAILED DESCRIPTION OF THE INVENTION

Because the rare earth Ce typically occurs naturally in combination with Nd and Pr and because of the cost advantages in reducing the concentration of Nd in rare earth permanent magnets the applicant has experimented with permanent magnets of the Fe—B—R type having various concentrations of Cerium as part of the rare earth component. The applicant has further varied the relative ratios and concentration of Nd and/or Pr of the rare earth component in relation to the amount of Ce, and measured the resultant magnetic properties of the Fe—B—R permanent magnets so created. Table I sets out the results for 35 samples of Fe—B—R type permanent magnets, where the composition of R was varied by utilizing various ratios of Ce, Pr, and Nd.

TABLE I

| Test Sample | Pr (wt % of R) | Ce (wt. % of R) | Nd (wt. % of R) | $H_{ci}$ (kOe) |
|---|---|---|---|---|
| B1-1 | 24.9 | 0.5 | 74.7 | 11.1 |
| B1-2 | 24.9 | 0.5 | 74.7 | 11.3 |
| B1-3 | 24.9 | 0.5 | 74.7 | 9.7 |
| B2-1 | 24.0 | 4.0 | 72.0 | 9.5 |
| B2-2 | 24.0 | 4.0 | 72.0 | 9.3 |
| B2-3 | 24.0 | 4.0 | 72.0 | 9.8 |
| B3-1 | 22.5 | 10.0 | 67.5 | 5.8 |
| B3-2 | 22.5 | 10.0 | 67.5 | 6.2 |
| B3-3 | 22.5 | 10.0 | 67.5 | 6.1 |
| B4-1 | 4.5 | 0.5 | 95.0 | 10.0 |
| B4-2 | 4.5 | 0.5 | 95.0 | 10.3 |
| B4-3 | 4.5 | 0.5 | 95.0 | 10.3 |
| B5-1 | 74.6 | 0.5 | 24.9 | 13.3 |
| B5-2 | 74.6 | 0.5 | 24.9 | 10.5 |
| B5-3 | 74.6 | 0.5 | 24.9 | 10.5 |
| E0 | 0.0 | 0.0 | 100.0 | 11.1 |
| E1 | 25.0 | 0.0 | 75.0 | 11.2 |
| E2 | 24.0 | 4.0 | 72.0 | 10.0 |
| E3 | 22.5 | 10.0 | 67.5 | 5.8 |
| E4 | 4.5 | 0.5 | 95.0 | 11.5 |
| E5 | 74.6 | 0.5 | 24.9 | 15.7 |
| E6 | 48.6 | 5.3 | 46.2 | 9.5 |
| E7 | 53.8 | 4.3 | 41.9 | 11.7 |
| E-A | 50.0 | 10.0 | 40.0 | 6.6 |
| E-B1 | 60.0 | 0.0 | 40.0 | 11.7 |
| E-B2 | 60.0 | 0.0 | 40.0 | 12.1 |

TABLE I-continued

| Test Sample | Pr (wt % of R) | Ce (wt. % of R) | Nd (wt. % of R) | $H_{ci}$ (kOe) |
|---|---|---|---|---|
| E-C1 | 90.0 | 10.0 | 0.0 | 7.7 |
| E-C2 | 90.0 | 10.0 | 0.0 | 7.2 |
| E-D1 | 100.0 | 0.0 | 0.0 | 9.8 |
| E-D2 | 100.0 | 0.0 | 0.0 | 10.7 |
| E-AB1 | 55.0 | 5.0 | 40.0 | 7.9 |
| E-AB2 | 55.0 | 5.0 | 40.0 | 9.0 |
| E-CD1 | 95.0 | 5.0 | 0.0 | 9.0 |
| E-CD2 | 95.0 | 5.0 | 0.0 | 9.3 |
| E-ABCD | 75.0 | 5.0 | 20.0 | 7.7 |

FIGS. 1–5 appended hereto are graphical plots of selected data from Table I, compiled for the purposes of assisting in interpreting the data in Table I and showing trends in magnetic performance arising from the various compositions of the R component of the 78 Fe-B 6.5-R 15.5 permanent magnet alloy compositions tested.

Figure 3:
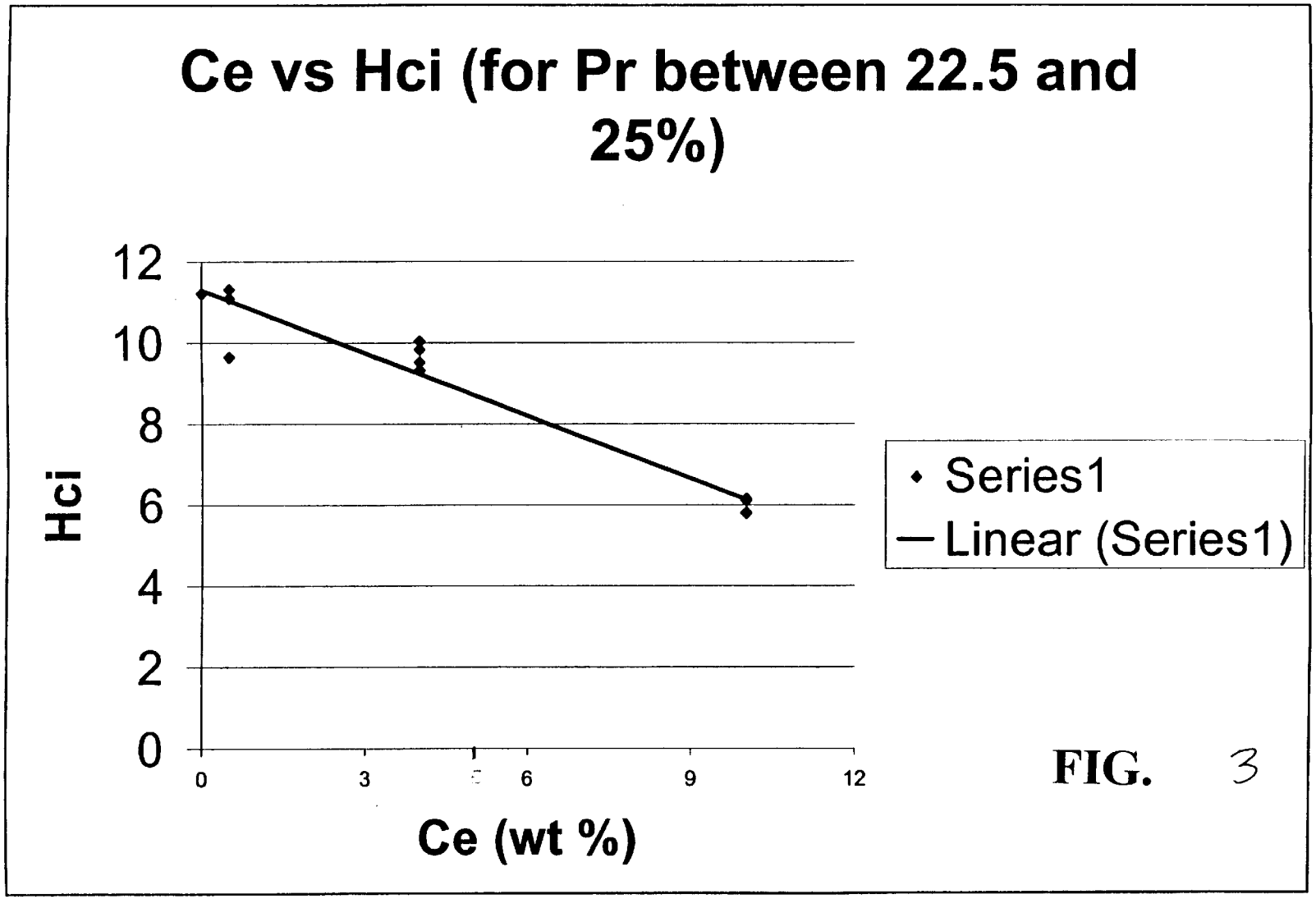
FIG. 3 is a graph similar to FIG. 4, showing selected result from Table I, plotting intrinsic coercive force $H_{ci}$ of a permanent magnet material of the Fe—B—R type as a function of Cerium composition of R, at Praseodymium concentrations between 22.5 and 25% of R.

Individual plots of the data are made for magnetic performance $H_{ci}$ versus Ce concentration, at constant or substantially constant values of Pr and Nd %, the percentage Nd being simply (100-[Ce]—[Pr])%. FIG. 3 shows a plot of magnetic performance $H_{ci}$ as a function of Cerium addition, at relatively constant values of Pr (from 22.5 to 25% wt. of R).

Figure 4:
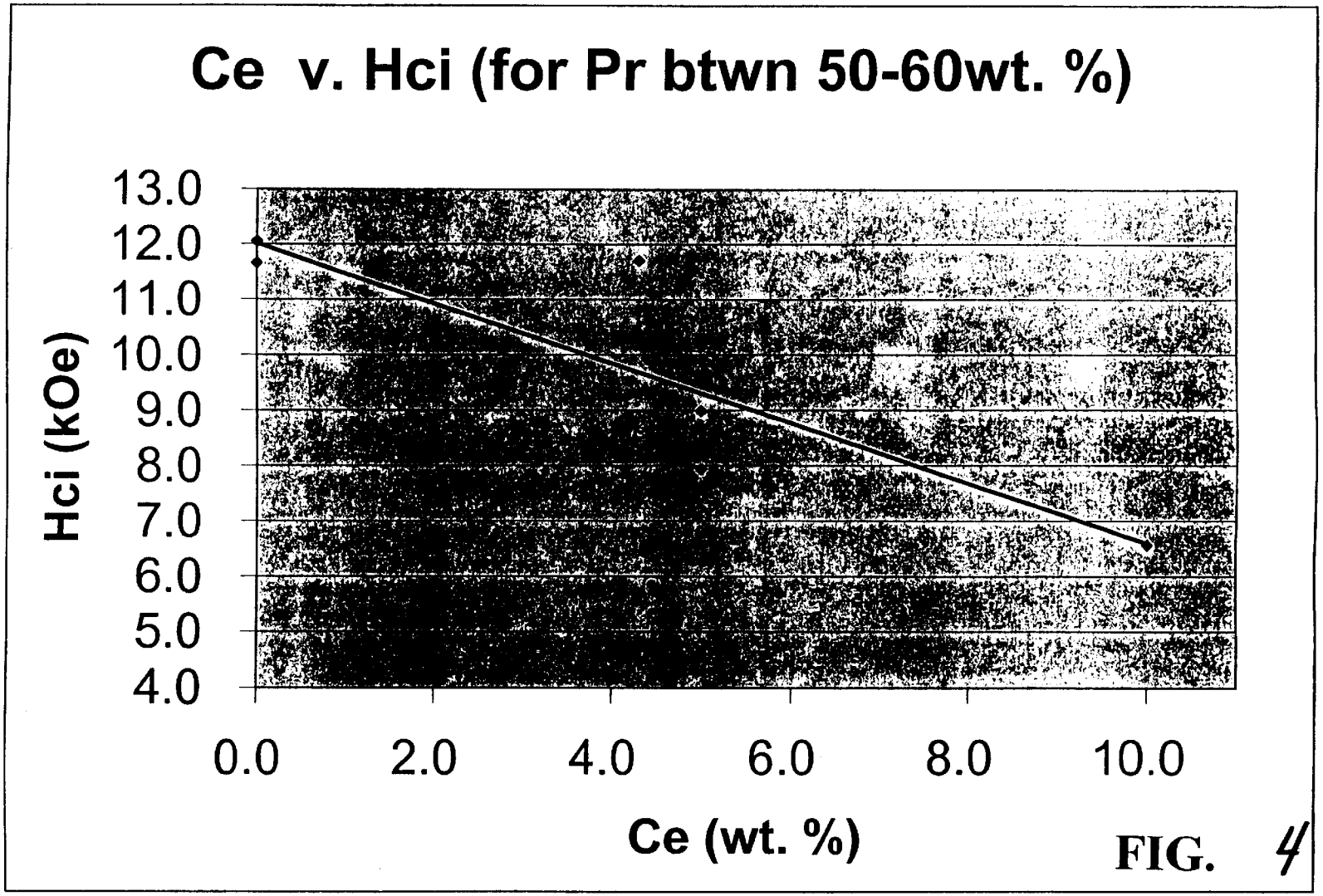
FIG. 4 is a graph similar to FIG. 3 showing selected results from Table I, plotting intrinsic coercive force $H_{ci}$ of a permanent magnet material of the Fe—B—R type as a function of Cerium composition of R, at Praseodymium concentrations between 50–60% of R.
Figure 5:
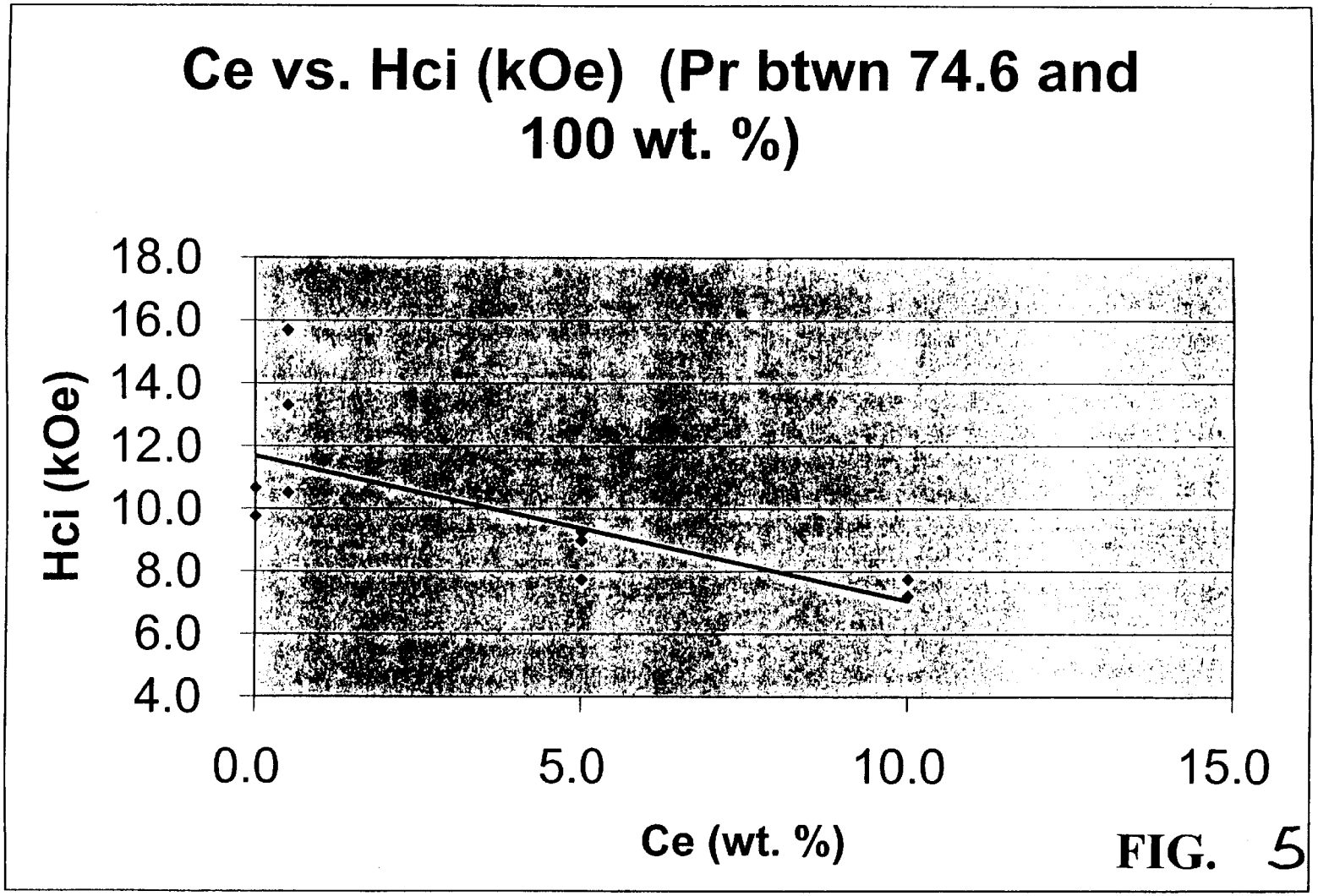
FIG. 5 is a graph similar to FIG. 4, showing selected results from Table I, plotting intrinsic coercive force $H_{ci}$ of a permanent magnet material of the Fe—B—R type as a function of Cerium composition of R, at Praseodymium concentrations between 74.6–100% of R.

FIG. 4 shows a plot of magnetic performance $H_{ci}$ as a function of Cerium addition, at relatively constant values of Pr (from 50–60 wt. %). FIG. 5 likewise shows a plot of magnetic performance $H_{ci}$ as a function of Cerium addition, at relatively constant values of Pr (from 74.6 to 100%).

In each of the aforementioned cases, as seen from FIGS. 3–5, it can broadly be said addition of Cerium, at least in the ranges between 5–10%, will cause a reduction in $H_{ci}$, from a value of 10–12 kOe at Ce-0% to a range of 6.1–7.8 range when Ce=10% of R.

Importantly, however, from a perusal Table I and FIGS. 3–5, the applicant has observed that for ranges of Cerium addition over 0% and up to about 5%, the reduction in magnetic performance ($H_{ci}$) is not that significant, and in some cases, the lower ranges of $H_{ci}$ at Ce-0% are exceeded by some of the upper ranges of $H_{ci}$ at Ce concentrations between 4–5%.

Analysis in the trends reflected in the data set out in Table I produce another surprising result. In particular, plots of $H_{ci}$ as a function of Pr (wt. %) where Ce amount is kept approximately constant generally tended to show an increase in magnetic performance $H_{ci}$ as the percentage of Pr was increased, at least for ranges of Ce concentrations at 0.5% and 10%.

Figure 1:
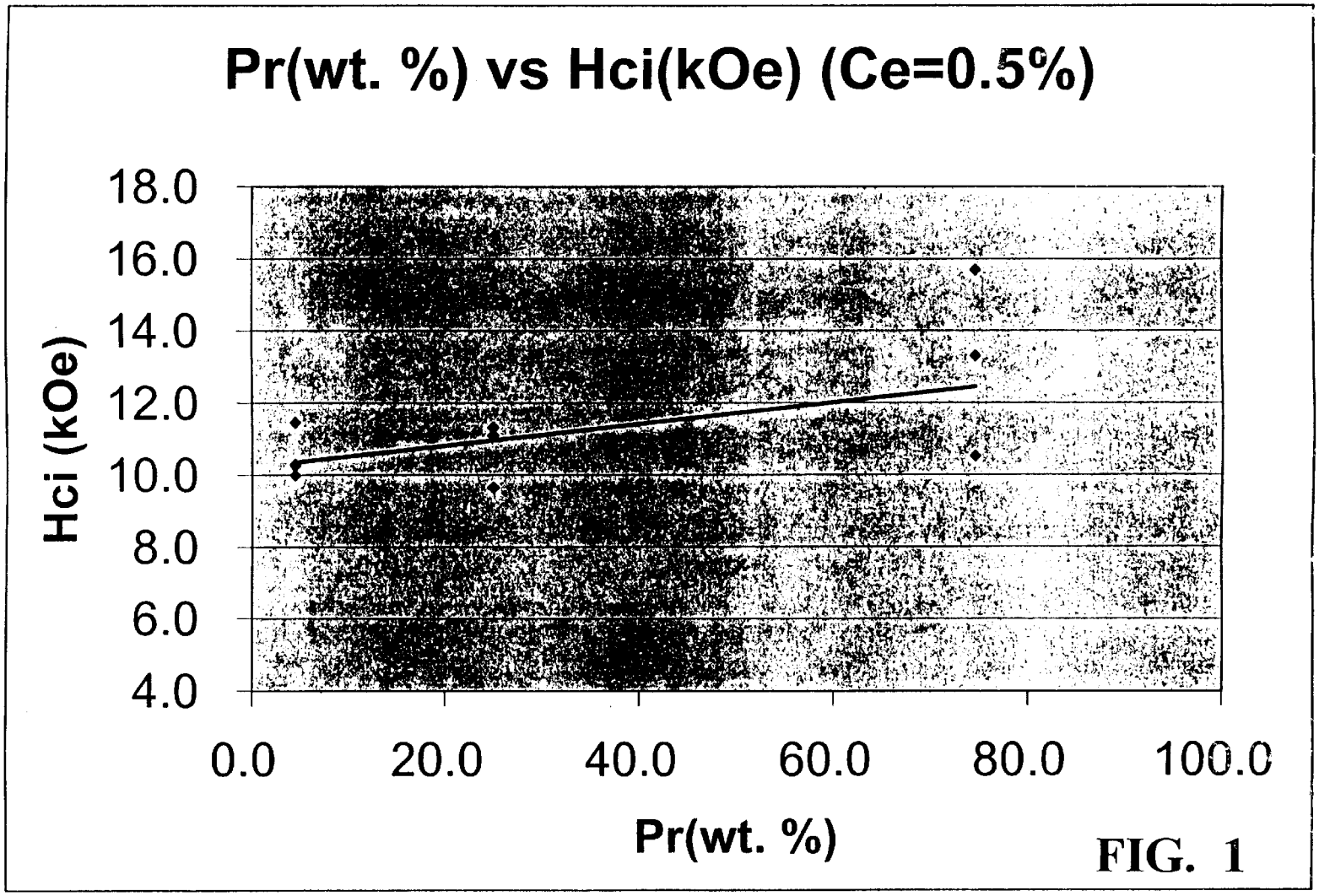
FIG. 1 is a graph of selected results from Table I, showing intrinsic coercive force $H_{ci}$ of a permanent magnet material of the Fe—B—R type as a function of Praseodymium composition of R, at Cerium concentrations of 0.5% of R.
Figure 2:
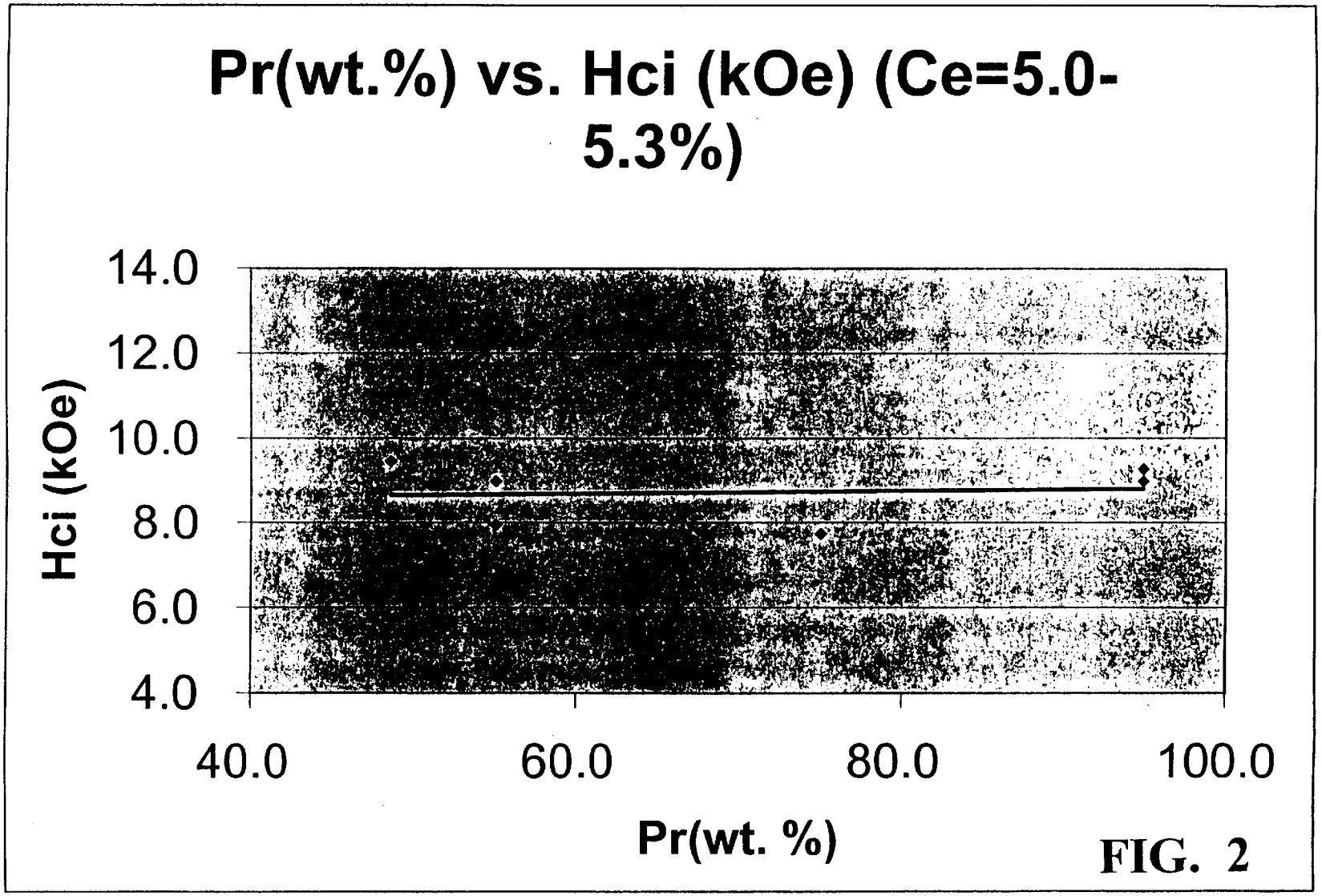
FIG. 2 is a graph of selected results from Table I, showing intrinsic coercive force $H_{ci}$ of a permanent magnet material of the Fe—B—R type as a function of Praseodymium composition of R, at Cerium concentrations between 5.0–5.3% of R.

FIGS. 1 and 2 show a plot of the magnetic performance of the sample, as measured by $H_{ci}$, as a function of Pr addition, for ranges of Ce=0.5% (FIG. 1) and Ce=5.0–5.3% (FIG. 2). For Ce=5.0–5.3% (FIG. 2), as may be seen from FIG. 2, substituting Pr for Nd and generally increasing the concentration of Pr from 48% to 95% (i.e. reducing Nd from 47% to 0%) had an average, as seen from a "best fit" line plotted in FIG. 2, no effect on $H_{ci}$.

In the case of Ce=0.5% (FIG. 1) increasing Pr from 4.5% to 74.6% created an increase in $H_{ci}$ from an average of 10.5 kOe [i.e. (10.0+10.3+10.3+11.5)/4] to an average of 12.5 kOe [i.e. (13.3+10.5+10.5+15.7)/4]. Because the decrease in $H_{ci}$ caused by adding Ce was not significant at Ce=0.5%, such addition of Pr up to in substitution of Nd, wherein Pr/Nd=3:1 appears to surprisingly have caused $H_{ci}$ to exceed the $H_{ci}$ for permanent magnets with no Ce added. In particular, the average $H_{ci}$ for Ce=0.5%, with Pr=74.6 and Nd=24.9%, was found to be 12.5 kOe, whereas, as stated earlier, average $H_{ci}$ for ranges of Pr and Nd with no Cerium added was only found to be 11.1 kOe. Indeed, the maximum $H_{ci}$ value of 15.7 kOe (at Pr=74.6% and Ce=0.5%) far exceeded the maximum value of $H_{ci}$ of 12.1 kOe where Ce=0.0%.

The manner of preparing the test specimens and obtaining the data of Table I will now be described.

(1) The raw material for each respective magnet sample containing the predetermined respective composition was measured out and melted by high frequency induction. The obtained melt was cast in a cooled mold to obtain an ingot specimen.

(2) The resulting ingot specimen was crushed, and subsequently finely pulverized in a ball mill, until powders having a particle size of 0.3 to 80 microns were obtained.

(3) A magnetic field of 7 to 20 kOe was thereafter applied to the milled powders to co-align each powder particle;

(4) The powders were subsequently compacted at a pressure of 1.5 Ton/cm$^2$ to produce a compacted body with a resultant density of approximately 6 g/cm$^2$;

(5) The compacted body was sintered in an inert gas atmosphere at a temperature of 1120 C for 2 hours.

(6) Values of $H_{ci}$ were then measured for each of the individual samples, and recorded in Table I.

It is recommended that the magnetic field applied to the powders to co-align the powder particles be at least 7 kOe. Further, the magnetic field that is applied to the powder may have a range of about 7 to about 30 kOe. In another embodiment, the magnetic field may range from about 7 to about 20 kOe.

The Fe—B—R magnet of the present invention containing Cerium in certain defined percentages may be prepared by the powder metallurgical sintering procedure used in preparation of the aforementioned samples. A description of the applicant's process, insofar as it relates to a process for the manufacture of the applicant's new composition, is set out below.

A metallic powder having a mean particle size of 0.3–80 microns, preferably less than 10 microns, is formed from a composition consisting of:

i) 13–19 atomic % R, preferably 15.16 atomic % R, wherein R essentially consists of the light rare earths Nd and/or Pr, and Ce, wherein Ce is between 0.2 to 5.0 wt. %, and preferably 0.5%, the balance of R essentially consists of Nd and Pr, and preferably approximately 74.6% Pr and 24.9% Nd.

ii) 4–8 atomic % B; preferably 6.5 atomic % B; and iii) the balance, preferably 78 atomic % Fe.

Such powder may be produced by known ball milling procedures, or Alpine jet milling. Since the distribution of particle size of the powder made by ball milling is wider than with powders made from Alpine jet mill, which definitely affects magnet alignment, Br, and thus $(BH)_{max}$, the latter set milling procedure is preferred.

The resultant powder may optionally be exposed to a magnetic field, of a strength equal to 7.0 to 20 kOe as in the case of the sample specimens. The metallic powder is then compacted at a pressure of at least 1.5 ton/cm$^2$ to produce a resultant compacted body having a density of at least 5 g/cm$^2$.

The resulting compacted body is then sintered in a reducing gas or inert gas atmosphere, or in a vacuum, at a temperature between 900–1200° C. and preferably between 1000–1180° C., for a period of 15 minutes to 8 hours and preferably for at least 1 hour.

While there have been described herein what are considered to be preferred and exemplary embodiments of the present invention, other modifications of the invention will now be apparent to those skilled in the art from the teachings herein. For a complete definition of the scope of the invention, reference is to be made to the appended claims.

Accordingly, what is desired to be secured by Letters patent is the invention as defined and differentiated in the following claims.

We claim:

1. A magnetic material having a composition of Fe—B—R the material consisting essentially of:

(i) 13–19 atomic % R, where R consists essentially of a mixture of rare earth elements Nd, Pr, and Ce, wherein Ce is between approximately 0.2 wt. %. and no more than 5.0 wt. % of R, Pr is between about 70–76 wt. % and Nd is 29.8–23.8 wt. %;

(ii) 4–20 atomic % B; and (iii) the balance comprising Fe with impurities.

2. The magnetic material of claim 1 wherein Ce is approximately 0.5–5.0 wt. % of R.

3. The magnetic material of claim 1 wherein R is 14.0–16.0 atomic %.

4. The magnetic material of claim 1 wherein B is 5.0–7.0 atomic %.

5. The magnetic material of claim 1 where R consists essentially of Pd and Nd in an approximate 3:1 ratio respectively (by weight %).

6. A magnetic resonance imaging (MRI) apparatus comprising the permanent magnetic material as claimed in claim 1.

7. The material of claim 1 wherein Pr is at least 70 wt. % of R, Ce is 0.5–3.0% wt. % of R, and the remaining percentage of R is essentially Nd.

8. The material of claim 7 wherein Pr is approximately 74.6 wt. % of R, Ce is approximately 0.5 wt. % of R, and the remaining percentage of R consists essentially of Nd.

9. The material of claim 4 wherein B is approximately 6.5 atomic %.

10. The material of claim 9 wherein R is approximately 15.5 atomic %.

11. A process for preparing a permanent magnetic material having a composition of Fe—B—R the process comprising the steps of:

(a) preparing a metallic powder having a mean particle size of 0.3–80 microns, the metallic powder formed from a composition consisting of 15–16 atomic % R, wherein R consists essentially of the light rare earths Nd, Pr, and Ce, wherein Ce is between 0.2–5.0 wt. % of the R, the balance of R consisting essentially of Nd and Pr where Pr is between about 70–76 wt. %, Nd is between 28.9–23.8 wt. %; 4–8 atomic % B; and at least 52 atomic % Fe;

(b) compacting the powder at a pressure of at least 1.5 ton/cm$^2$; and (c) sintering the resulted body at a temperature of 900–1200° C. in a non-oxidizing or reducing atmosphere.

12. The process as claimed in claim 11 wherein the metallic powder is prepared by melting metallic material, cooling the resultant alloy, and pulverizing the alloy to form the metallic powder.

13. The process as claimed in claim 12 wherein the step of pulverizing the alloy comprises ball milling the alloy to form the powder.

14. The process as claimed in claim 12 wherein the step of pulverizing the alloy comprises jet milling the alloy to form the powder.

15. The process as claimed in claim 11 further comprising the step, while compacting the powder, applying a magnetic field of 7 to 13 kOe.

16. The process as claimed in claim 15 therein the metallic powder is prepared by milling to produce a mean particle size no more than 10.0 microns.

17. A permanent magnetic material having a composition of Fe—B—R when made in accordance with the following process, namely:

(a) preparing a metallic powder having a mean particle size of 0.3–80 microns, the metallic powder formed from a composition consisting of 15–16 atomic % R, wherein R consists essentially of the light rare earths Nd, Pr, and Ce, wherein Ce is between 0.2–5.0 wt. % of R, the balance of R consisting essentially of (by wt. %) Nd and Pr; 4–48 atomic % B, and at least 52 atomic % Fe;

(b) compacting the powder at a pressure of at least 1.5 ton/cm$^2$; and (c) sintering the resulted body at a temperature of 900–1200° C. in a non-oxidizing or reducing atmosphere.

18. The material as claimed in claim 17 wherein R comprises at least 70 wt. % Pr, and B comprises 5–7 atomic %.

19. The material as claimed in claim 18 wherein the resulting body is sintered at a temperature of 1000–1180° C.

20. The permanent magnetic material as claimed in claim 18 wherein the metallic powder is prepared by milling to produce a mean particle size no more than 7.0 micron.

* * * * *